US005366390A

United States Patent [19]

Kinross et al.

[11] Patent Number: 5,366,390

[45] Date of Patent: Nov. 22, 1994

[54] LOW PROFILE CAM-IN SOCKET HAVING TERMINALS ENGAGING A RIB

[75] Inventors: Timothy J. Kinross, Greensboro; Roger L. Thrush, Clemmons, both of N.C.

[73] Assignee: The Whitaker Corporation, Wilmington, Del.

[21] Appl. No.: 122,080

[22] Filed: Sep. 15, 1993

[51] Int. Cl.[5] ..... H01R 9/09

[52] U.S. Cl. ..... 439/636; 439/630

[58] Field of Search ..... 439/636, 630, 631, 633, 439/634, 635, 62

[56] References Cited

U.S. PATENT DOCUMENTS

| | | | |
|---|---|---|---|
| 3,233,208 | 1/1966 | Ruehlemann et al. | 439/636 |
| 4,946,403 | 8/1990 | Billman et al. | 439/326 |
| 4,973,270 | 11/1990 | Billman et al. | 439/630 |
| 5,013,264 | 5/1991 | Fondreault | 439/636 |
| 5,026,292 | 6/1991 | Pickles et al. | 439/108 |
| 5,041,005 | 8/1991 | McHugh | 439/326 |

*Primary Examiner*—Daniel W. Howell
*Attorney, Agent, or Firm*—Robert J. Kapalka

[57] ABSTRACT

A socket for electrically connecting a circuit panel to a substrate comprises an insulative housing (10) defining an elongated slot (12) for receiving the circuit panel (14). A plurality of terminal receiving cavities (16) are spaced apart along a length of the slot, and each of the cavities is open to the slot on opposite sides (22, 24) thereof. The housing includes a rib (20) extending beneath the slot along its length. A plurality of electrically-conductive terminals (30) are disposed in respective ones of the cavities. Each of the terminals comprises an integral body including a housing engaging section (32) having opposed surfaces (34, 36) each gripping a respective opposite side (46, 48) of the rib. Each terminal has a lead (58) extending to an exterior of the housing for electrically engaging a substrate, and a pair of resilient contact arms (52, 62) extending into the slot from respective opposite sides of the slot for electrically engaging opposite sides of the circuit panel.

10 Claims, 4 Drawing Sheets

LOW PROFILE CAM-IN SOCKET HAVING TERMINALS ENGAGING A RIB

FIELD OF THE INVENTION

The invention relates to a socket for electrically interconnecting circuit panels, and more particularly, to a housing and terminals for a cam-in socket wherein the terminals are retained in the housing by gripping opposite sides of a rib of the housing, thereby providing a low profile socket.

BACKGROUND OF THE INVENTION

A single in-line memory module (SIMM) presents a high density, low profile single in-line package for electronic components such as dynamic random access memory integrated circuit components. Each module comprises a plurality of integrated circuit components mounted on a circuit panel card having contact surfaces adjacent one edge. A plurality of these circuit panels, or daughtercards, can then be mounted on a circuit board mothercard.

Sockets known as SIMM sockets are well known to receive the edge of a circuit panel daughtercard and establish an electrical interconnection with a circuit board mothercard. U.S. Pat. No. 4,946,403 discloses a SIMM socket which permits a circuit panel to be inserted into the socket with a low insertion force. This patent also discloses a right angle SIMM socket for mounting the daughtercard parallel to the mothercard in order to reduce overall height of a packaged daughtercard/mothercard assembly. A problem with right angle mounting is that the mothercard must have a relatively large surface area to accommodate a plurality of daughtercards.

U.S. Pat. No. 5,041,005 discloses a low profile SIMM socket which permits mounting a daughtercard at an angle such as twenty-five degrees relative to the mothercard. This socket permits a plurality of daughtercards to be mounted in parallel side by side relationship while still providing a relatively low overall height for the packaged assembly.

In order to achieve a still denser array of daughtercards on a mothercard, it would be advantageous to narrow the SIMM sockets in order that they could be mounted on the mothercard in closer parallel relationship. Width of the sockets is primarily limited by the profile of the terminals which must be housed therein. Each of the above-referenced patents discloses a socket housing having a central rib which extends beneath a panel receiving slot along a length of the housing. The patents disclose terminals which are retained in their respective socket housings by two separate and spaced apart retention elements, one of the elements engaging on the central rib, and the other of the elements engaging an inner surface of an outer wall of the housing. Width of the sockets could be reduced if the terminal retention elements were localized so as to engage only one portion of the socket housing, in particular, the central rib.

Additionally, the above-referenced patents disclose camin sockets wherein a daughtercard is inserted into the socket at a first angle relative to the mothercard, the insertion being resisted by a zero or low insertion force. The daughtercard is then rotated to a second angle relative to the mothercard, the rotation being resisted by spring portions of the terminals which are designed to provide a relatively low resistance to the rotation. Each of the terminals has two contact portions for engaging opposite sides of the daughtercard. One of the contact portions is disposed on a substantially cantilever spring arm, and the other of the contact portions is disposed on a substantially C-shaped spring arm. Each of the spring arms must have a low spring rate in order to provide a fairly uniform normal force on different daughtercards having a thickness tolerance which varies over a relatively wide range. The C-shaped spring arm has multiple flexuous sections along its length and therefor has an inherently lower spring rate than the cantilever spring arm which has only one flexuous section at its root. It would be advantageous for the terminal to have contact portions on a pair of curved spring arms having low spring rates so that the socket would be more tolerant of variations in daughtercard thickness.

The present invention provides a SIMM socket having a reduced profile to enable denser packaging on a circuit board. The socket includes a housing having a central rib and terminals which are retained in the housing by opposed surfaces of the terminals gripping opposite sides of the central rib. The terminals have contacts disposed on substantially C-shaped spring members which have low spring rates so as to accept circuit panels having a wide range of thicknesses.

SUMMARY OF TEE INVENTION

The present invention provides a socket for electrically connecting a circuit panel to a substrate, and a terminal for use in the socket. The socket includes an insulative housing defining an elongated slot for receiving the circuit panel, and a plurality of terminal-receiving cavities spaced apart along a length of the slot. Each of the terminal-receiving cavities is open to the slot on opposite sides of the slot. The housing includes a rib extending beneath the slot along the length of the slot. A plurality of electrically-conductive terminals are disposed in respective ones of the cavities. Each of the terminals comprises an integral body including a housing engaging section having opposed surfaces each gripping a respective opposite side of the rib. The body further includes a lead extending to an exterior of the housing for electrically engaging the substrate, and a pair of resilient contact arms extending into the slot from respective opposite sides of the slot for electrically engaging opposite sides of the circuit panel.

BRIEF DESCRIPTION OF THE DRAWINGS

There are shown in the drawings the embodiments of the invention that are presently preferred. It should be understood, however, that the invention is not limited to the precise arrangements and instrumentalities shown in the drawings, wherein.

DETAILED DESCRIPTION OF THE PREFERRED EMBODIMENT

Figure 1:
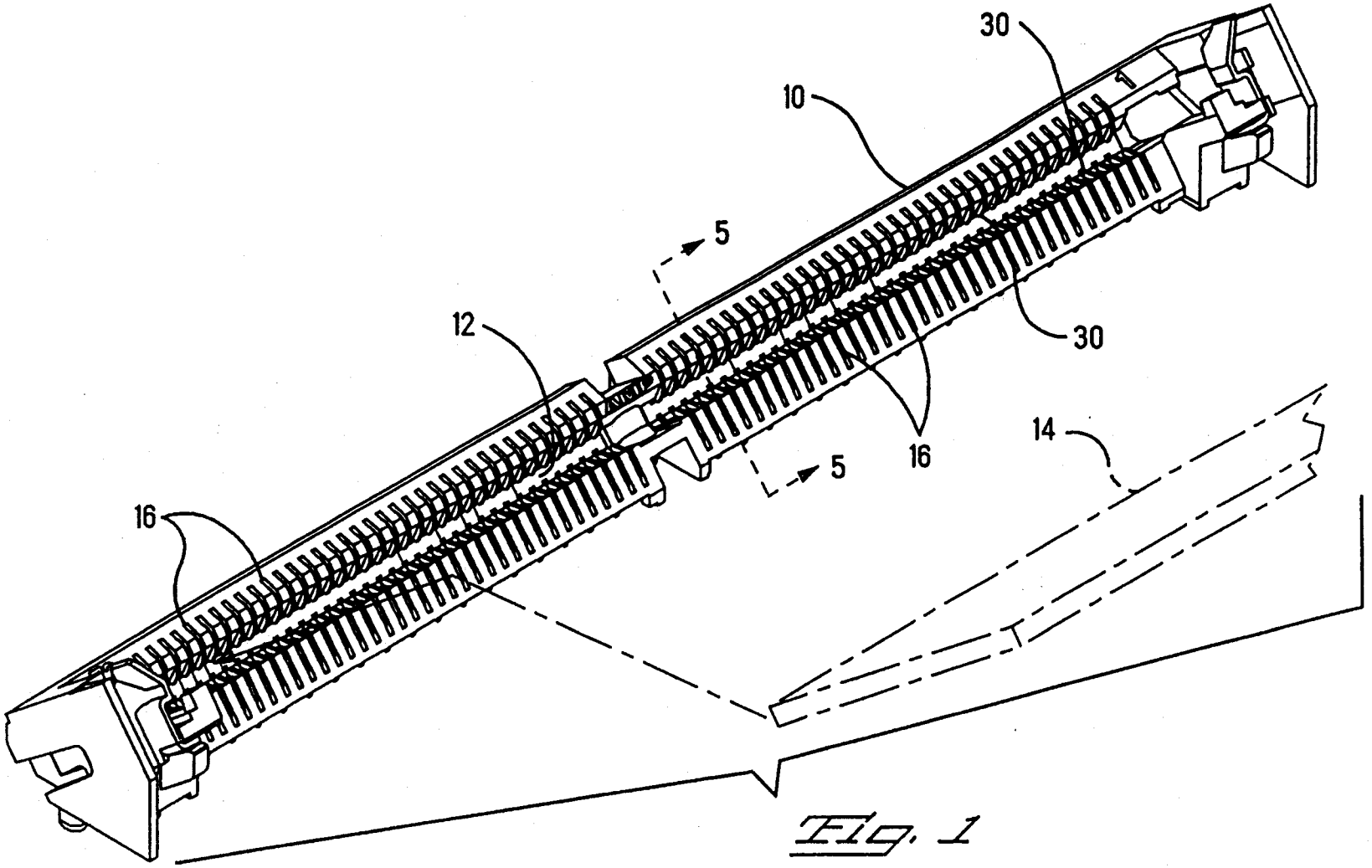
FIG. 1 is a perspective view of a socket according to the invention.
Figure 2:
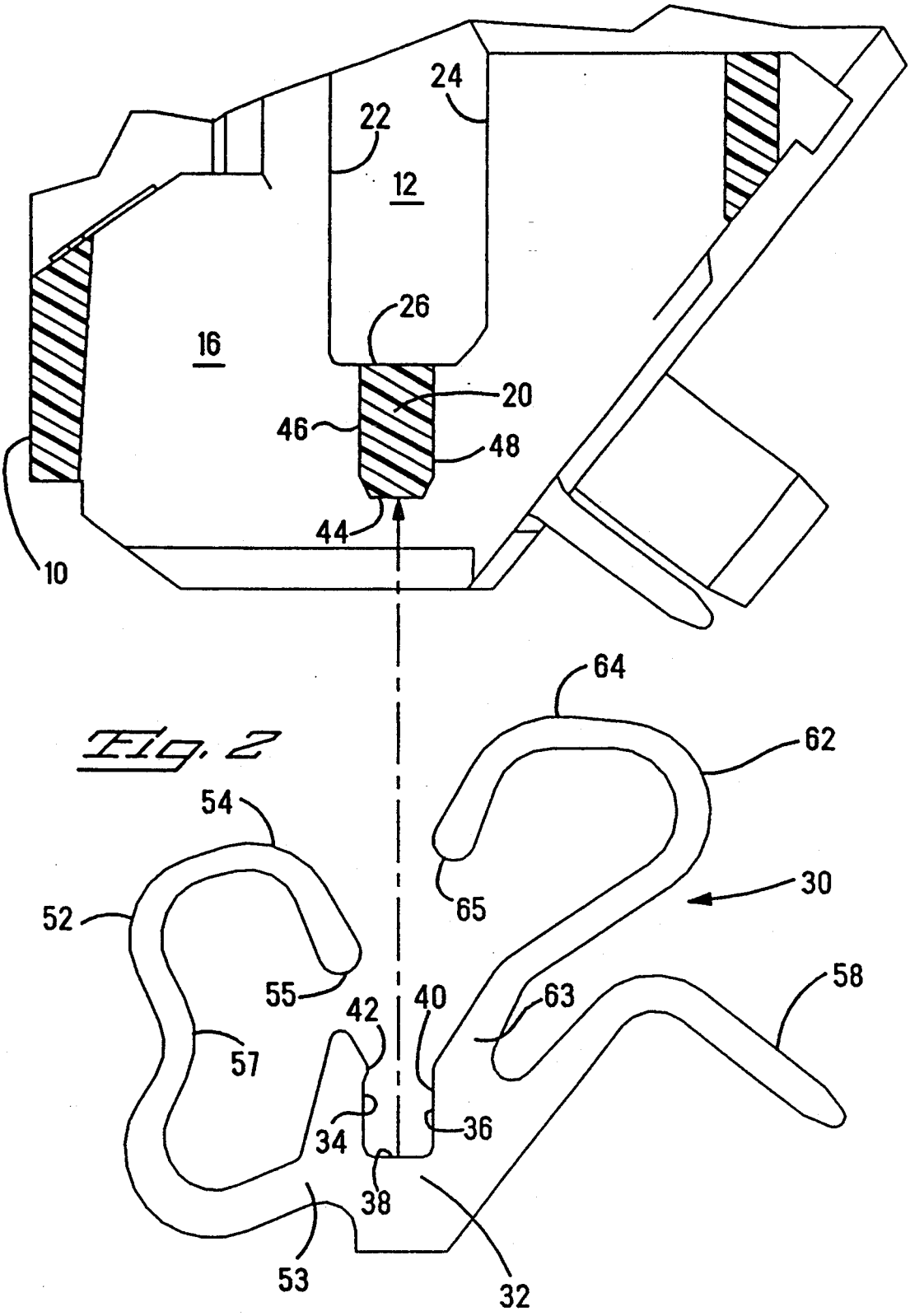
FIG. 2 is an exploded cross-sectional view of a housing and terminal for a socket according to the invention.

As shown in FIGS. 1 and 2, a socket according to the invention comprises an insulative housing 10 which is preferably made from a plastic such as glass reinforced liquid crystal polymer. The housing 10 has an elongated slot 12 dimensioned to receive a circuit panel 14. A plurality of terminal-receiving cavities 16 are spaced apart along a length of the slot 12. The cavities 16 extend perpendicular to the slot 12 through an interior of the housing 10, each of the cavities 16 being open to the slot 12 through opposite sidewalls 22, 24 of the slot 12, wherein terminals disposed in the cavities 16 can communicate through the interior of the housing 10 between opposite sides of a circuit panel 14 disposed in the slot 12.

The housing 10 includes a rib 20 that extends beneath the slot 12 along the length of the slot. The rib 20 is preferably centrally located beneath the slot 12 with a top surface of the rib 20 defining at least a portion of a floor 26 of the slot 12. The rib 20 has opposite sides 46, 48 that are exposed within each of the cavities 16.

Figure 3:
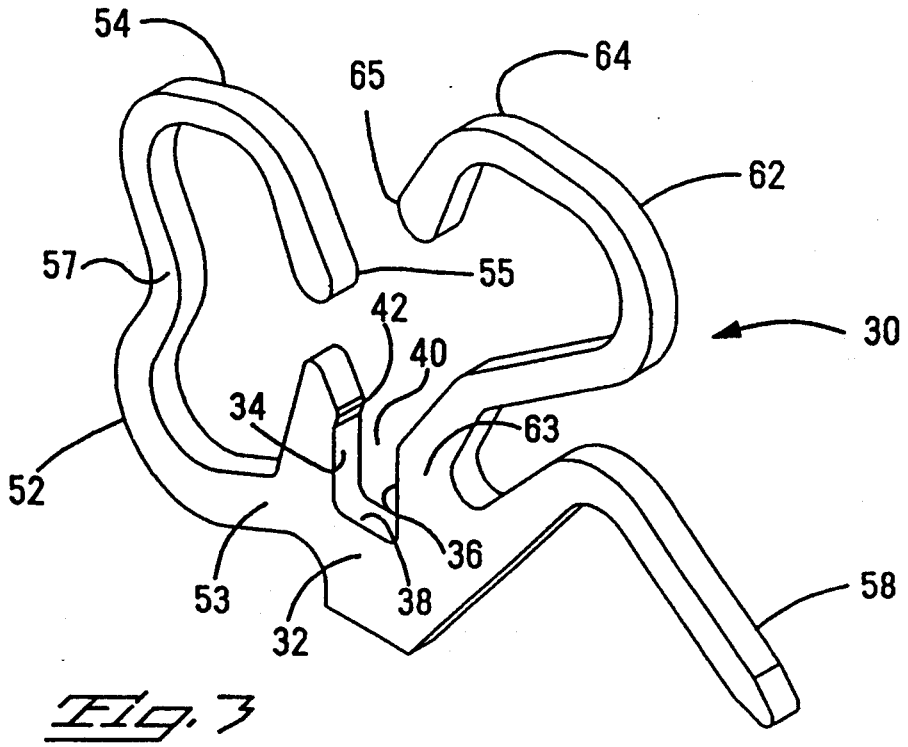
FIG. 3 is a perspective view of a terminal for the socket according to the invention.

A plurality of electrically-conductive terminals 30 are disposed in respective ones of the cavities 16. The terminals 30 are inserted into the cavities 16 from a bottom of the housing 10 as shown in FIG. 2, preferably by automatic insertion machinery. As shown in FIGS. 2 and 3, each of the terminals 30 comprises an integral body that is preferably edge-stamped from a blank strip of phosphor bronze material. The terminal body includes a housing engaging section 32 that defines an upwardly-open slot 40 which receives the rib 20 of the housing 10. Surfaces of the slot 40 define opposed gripping surfaces 34, 36 which are spaced apart at a distance selected to be narrower than a width of the rib 20. Forceful insertion of the terminal 30 into the housing 10 causes the gripping surfaces 34, 36 to spread further apart as the rib 20 enters the slot 40, whereby the rib 20 becomes frictionally engaged between the gripping surfaces 34, 36.

In a preferred embodiment, one of the gripping surfaces 34 includes a barb 42 which digs into the plastic of the rib 20 so as to firmly secure the terminal 30 in the cavity 16. The other gripping surface 36 is a planar surface extending perpendicular to a bottom planar surface 38 of the slot 40. The planar surfaces 36 and 38 abut respective planar surfaces 44 and 48 of the rib 20 when the terminal is fully inserted in the cavity 16 as shown in FIG. 4, thereby locating the terminal 30 with respect to the slot 12 in the housing 10.

According to the invention, each of the terminals 30 has a pair of resilient contact arms 52, 62 which extend from fixed origins 53, 63, respectively, near the housing engaging section 32, to free ends 55, 65, respectively. The contact arms 52, 62 extend into the slot 12 through respective opposite sidewalls 22, 24 of the slot 12 so that circuit panel engaging portions of the arms 52, 62 may engage circuit traces on opposite sides of a circuit panel 14 when the circuit panel is inserted into the slot.

In the preferred embodiment shown in FIGS. 2 and 3, each of the contact arms 52, 62 has a substantially C-shaped curved profile that extends from its respective fixed origin 53, 63 to a highest portion 54, 64 and thence downwardly to its respective free end 55, 65 which defines the circuit panel engaging portion of the contact arm. Every bend of a contact arm provides a flexuous section, i.e., a section that provides flexibility, for the contact arm. The curved profile of each contact arm 52, 62 defines a plurality of flexuous sections which result in each contact arm having a spring rate that is lower than the spring rate of a simple cantilever beam having the same overall length as that contact arm. Thus, the contact arms 52, 62 are provided with relatively low spring rates in a minimum size package. The low spring rates enable. the socket to accept different circuit panels 14 having a thickness which varies over a relatively wide tolerance range because the range of normal forces encountered by the different thicknesses of circuit panels is kept to a minimum. Either of the contact arms 52, 62 may further include additional curved sections such as S-bend section 57, thereby providing further resilience for the contact arm and a further lowering of its spring rate.

Figure 4:
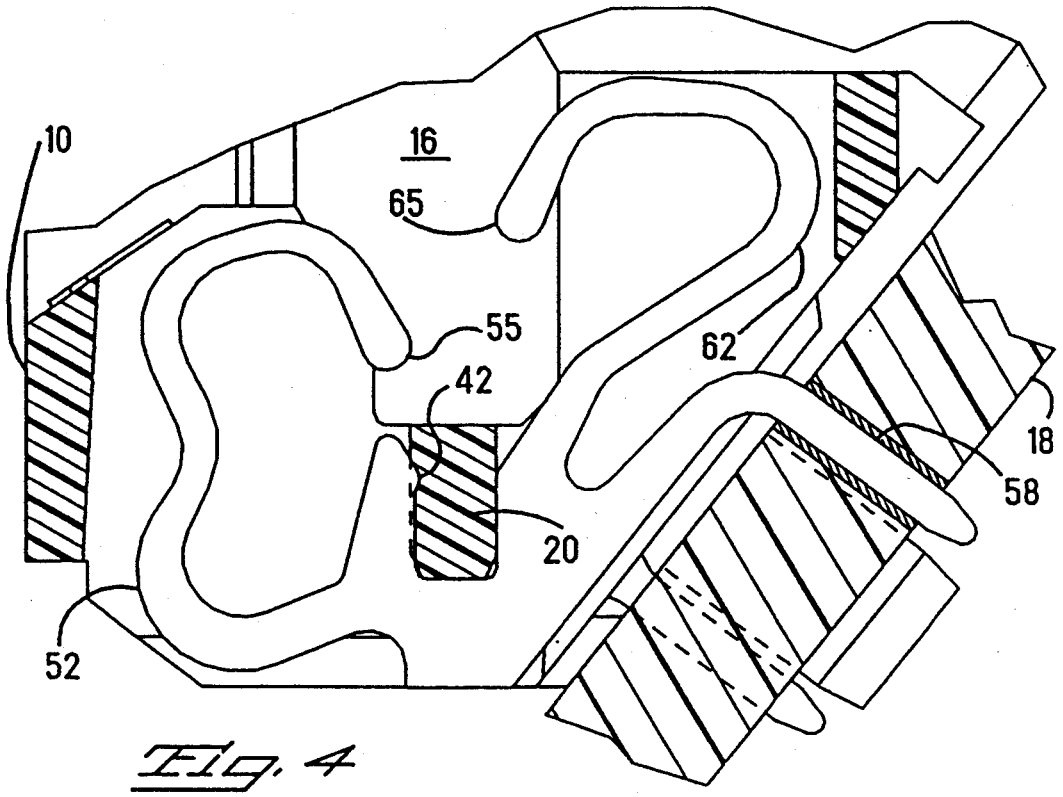
FIG. 4 is a cross-sectional view of the socket having a terminal disposed therein.

Each terminal 30 further includes a lead 58 which extends to an exterior of the housing 10 when the terminal 30 is disposed therein as shown in FIG. 4, the lead 58 being engageable with respective circuit traces on a substrate 18 such as a circuit board. The lead 58 may be of the post type (shown) which registers in a plated through-hole in the substrate 18. Alternatively, the lead 58 may include a foot (not shown) for surface mounting on a contact pad of the substrate 18. In any event, the contact arms 52, 62 and the lead 58 enable each terminal 30 to provide an electrical interconnection between associated circuit traces on the circuit panel 14 and the substrate 18.

Figure 5:
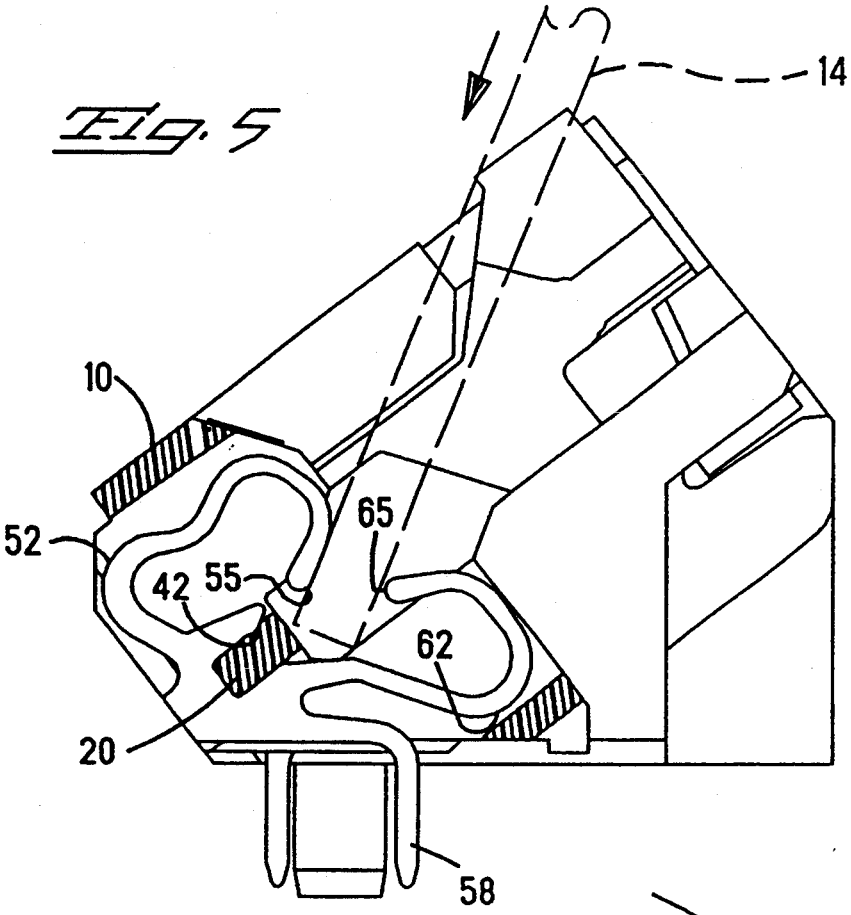
FIG. 5 is a cross-sectional view of the socket taken along line 5—5 of FIG. 1, and a circuit panel in an initial position during insertion into the socket.
Figure 6:
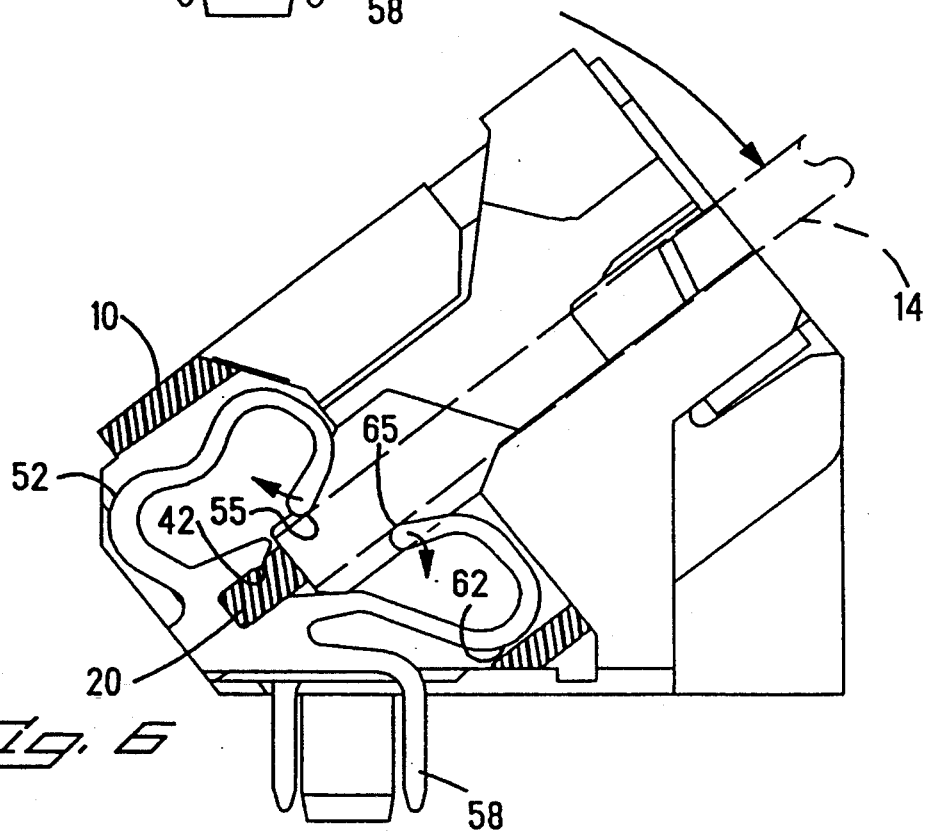
FIG. 6 is a cross-sectional view of the socket having a circuit panel disposed in a final position therein.

As shown in FIG. 5, a circuit panel 14 is inserted into the slot 12 at an insertion angle wherein the circuit panel enters freely between free ends of the contact arms 52, 62 and encounters little or no resistance to insertion. The circuit panel 14 is then rotated to a final position in the direction of the arrow shown in FIG. 6. During the rotation, the circuit panel 14 functions as a lever to cam the contact arms 52, 62 at least partly beyond the slot 12 and into the cavity 16 against a resistance offered by the resilient contact arms. Also during the rotation, circuit panel engaging portions at the free ends 55, 65 slide on contact traces (not shown) of the circuit panel 14, thereby wiping the contact surfaces clean. As can be seen, the one free end 65 is relatively higher above the rib 20 and the slot 40 than the other free end 55.

A socket according to the invention has the advantage that the terminals 30 are retained in the housing 10 by two retention elements (gripping surfaces 34, 36) which are localized at the housing engaging section 32 and which engage opposite sides of a single element of the housing 10, i.e., the rib 12. The rib 12 may be relatively narrow and, since no side wall of the housing 10 is engaged by the terminal 30, the housing 10 can be made narrower than previously possible, thereby providing a low profile socket. Further, the invention provides a socket wherein the contact arms 52, 62 have low spring rates, but neither of the contact arms is preloaded against the rib 12 as is common in the prior art sockets. The invention thus eliminates a problem wherein a circuit panel contacting portion of the contact arm picks up a smear of plastic from the rib 12 as the terminal is inserted into the housing, which smear of plastic could prevent good electrical contact of the contact arm with a circuit panel inserted received in the socket.

The invention having been disclosed, a number of variations will now become apparent to those skilled in the art. Whereas the invention is intended to encompass the foregoing preferred embodiments as well as a reasonable range of equivalents, reference should be made to the appended claims rather than the foregoing discussion of examples, in order to assess the scope of the invention in which exclusive rights are claimed.

We claim:

1. A socket for electrically connecting a circuit panel to a substrate, the socket comprising:

an insulative housing defining an elongated slot for receiving the circuit panel, and a plurality of terminal-receiving cavities spaced apart along a length of the slot, each of the cavities being open to the slot on opposite sides thereof, the housing including a rib extending beneath the slot along the length thereof; and, a plurality of electrically-conductive terminals disposed in respective ones of the cavities, each of the terminals comprising an integral body including a housing engaging section having opposed surfaces each gripping a respective opposite side of the rib, a lead extending to an exterior of the housing for electrically engaging the substrate, and a pair of resilient contact arms extending into the slot from respective ones of the opposite sides of the slot for electrically engaging opposite sides of the circuit panel, the contact arms having respective free ends, and one of the free ends being relatively higher above the rib than the Other of the free ends.

2. The socket according to claim 1, wherein the rib is centrally disposed beneath the slot.

3. The socket according to claim 1, wherein a surface of the rib defines at least a portion of a boundary wall of the slot.

4. The socket according to claim 1, wherein each of the contact arms has a profile that extends from a fixed origin upwardly to a highest portion and then downwardly to a circuit panel engaging portion.

5. The socket according to claim 1, wherein each of the contact arms has a profile that defines at least two bends.

6. The socket according to claim 1, wherein one of the opposed surfaces of the housing engaging section defines a barb.

7. In combination with a socket having a circuit panel receiving slot and a rib extending beneath the slot along a length thereof, a terminal for establishing electrical contact with a circuit panel disposed in the socket, comprising:

an electrically conductive integral body including a section defining an upwardly-open rib receiving slot, surfaces of the rib receiving slot defining opposed gripping surfaces at a selected spaced apart distance which is narrower than a width of the rib such that the rib is engageable between the opposed gripping surfaces, and a pair of resilient contact arms extending from fixed origins on respective opposite sides of the slot, each of the contact arms having a circuit panel engaging portion disposed above the rib receiving slot, and one of the circuit panel engaging portions being relatively higher above the rib receiving slot than the other of the circuit panel engaging portions.

8. The terminal according to claim 7, wherein each of the contact arms has a profile that extends from a fixed origin upwardly to a highest portion and then downwardly to its respective said circuit panel engaging portion.

9. The terminal according to claim 7, wherein each of the contact arms has a profile that defines at least two bends.

10. The terminal according to claim 8, wherein one of the opposed surfaces of the housing engaging section defines a barb.

* * * * *